US007424751B1

(12) United States Patent
Miller

(10) Patent No.: US 7,424,751 B1
(45) Date of Patent: Sep. 16, 2008

(54) CONVERTIBLE GARMENT

(76) Inventor: Eric P Miller, 8220 Grubb Rd., McKean, PA (US) 16426

( * ) Notice: Subject to any disclaimer, the term of this patent is extended or adjusted under 35 U.S.C. 154(b) by 88 days.

(21) Appl. No.: 11/416,342

(22) Filed: May 1, 2006

(51) Int. Cl.
*A42B 1/00* (2006.01)

(52) U.S. Cl. ..... 2/209.11; 2/202

(58) Field of Classification Search ..... 2/171, 2/195.1, 209.11, 209.12, 202, 204, 206; 112/475.11, 112/475.01, 402
See application file for complete search history.

(56) References Cited

U.S. PATENT DOCUMENTS 241,149 A * 5/1881 Northrup ..... 2/195.1
1,915,092 A * 6/1933 Hendrickson ..... 66/171
2,998,611 A * 9/1961 Schuessler ..... 2/181.4
3,157,887 A * 11/1964 Rothstein ..... 2/203
3,449,766 A * 6/1969 Friedman et al. ..... 2/209.12
3,531,952 A * 10/1970 Chesebro, Jr. ..... 66/171
3,717,882 A * 2/1973 Schuessler ..... 2/173
6,026,514 A * 2/2000 Fricker ..... 2/209.11

* cited by examiner

*Primary Examiner*—Katherine Moran
*Assistant Examiner*—Sally Colson Cline
(74) *Attorney, Agent, or Firm*—Richard K Thomson

(57) ABSTRACT

A tubular length of fabric has a plurality of V's cut on each end. A first end is pulled inside the fabric tube, the V's of the first end are aligned with the V's of the second end and the peripheral edges of the V's sewn together. A hole formed in one layer of the fabric forms the means to covert the garment from a closed-topped hat to a cylindrical tube which can be worn as a variety of garments including a neck gaiter, a face gaiter, an open-topped hat and a head band. The method of making the garment is also set forth.

4 Claims, 7 Drawing Sheets

CONVERTIBLE GARMENT

BACKGROUND AND SUMMARY OF THE INVENTION

The present invention is directed to the field of apparel. More particularly, the present invention is directed to a garment which can be worn as a variety of forms of apparel including a hat (both open and closed top), a muffler/gaiter, and a head band.

Apparel which has multiple functions is becoming quite popular in today's culture. The present invention promises to fill a niche by providing a garment which has several multiple uses. The garment of the present invention comprises a) a tubular length of fabric with a plurality of V's cut on a first end and a like plurality of V's cut on an opposing second end, each V having a pair of opposing sides; b) the tubular length of fabric having i) one of each of the plurality of sides of the plurality of V's on the first end being stitched to an opposing one of each of the plurality of sides on the second end to create a loop of fabric of the tubular length of fabric; ii) a hole positioned in one face of the tubular length of fabric, the hole being of substantial size; whereby said created loop of tubular fabric may be worn as a number of items of apparel with the created loop right side out and, when desired, the created loop of fabric may be turned inside out to form a closed-ended stocking cap. Most preferably, the plurality of V's equals four. In addition, it is preferred that the hole be in direct alignment with one of the V-s on one end of the fabric.

In another facet of the present invention, a method of making a convertible garment comprises the steps of a) cutting a first plurality of V's on a first distal end of a tubular length of cloth, the tubular length of cloth having two layers, said first plurality of V's being formed on both layers; b) cutting a second plurality of V's on a second opposing distal end of the tubular length of cloth, the second plurality of V's being formed on both layers; c) creating a hole in one layer of the tubular length of cloth centered above one of the V's; d) inverting said tubular length of cloth by pulling all of the tubular length of cloth through the hole; e) aligning the first plurality of V's on the first distal end with the second plurality of V's on the second distal end; f) stitching an outer periphery of aligned first and second distal ends such that each side of each V on the first distal end is sewn to a side of each V on the second distal end creating a continuous band of the tubular length of fabric.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
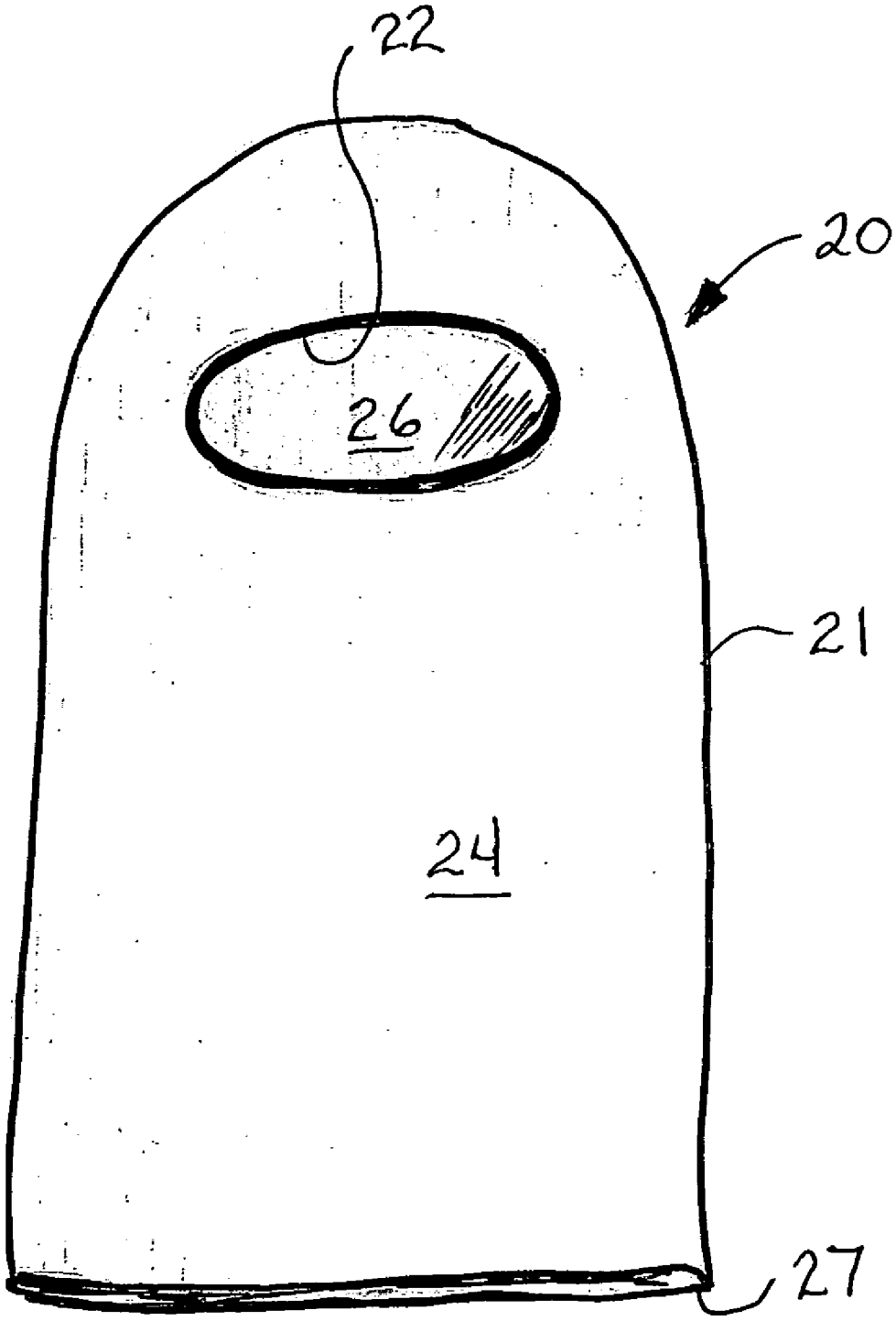
FIG. 1 is a front view of the convertible garment shown configured as a closed-topped hat with the hole visible.
Figure 2:
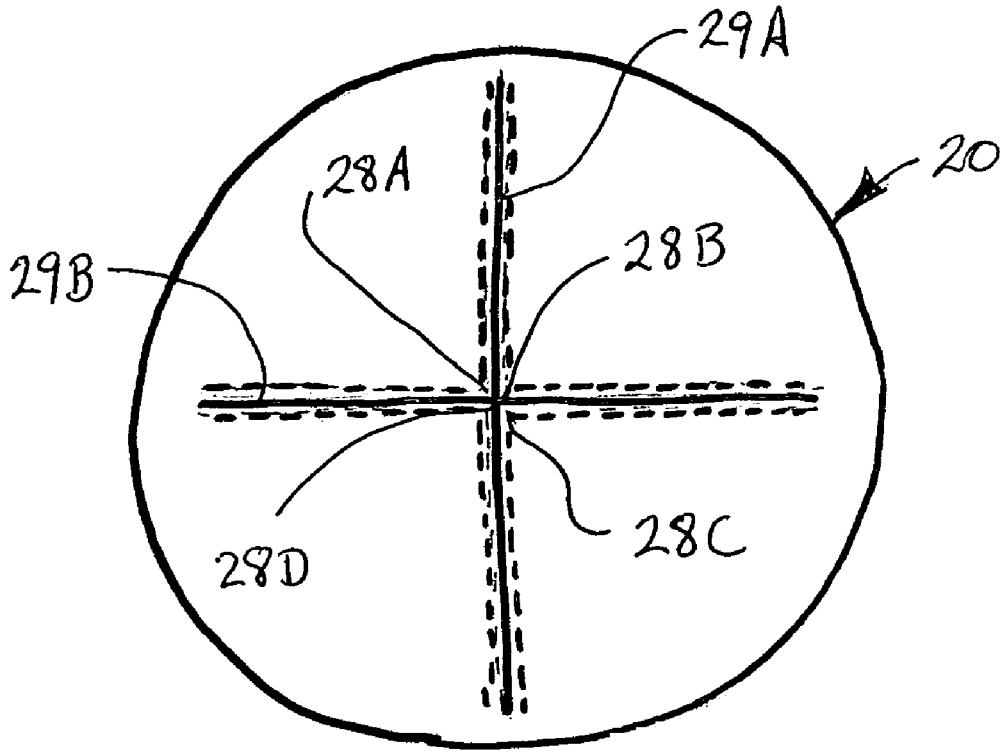
FIG. 2 shows a top view of the garment as it appears once stitching is complete.

A first embodiment of the convertible garment of the present invention is shown in FIG. 1 generally at 20. As shown in FIG. 1, convertible garment 20 is configured as a stocking cap or closed-topped hat having a hole 22 through first layer 24 of the fabric 21. As will be discussed in more detail, hole 22 does not penetrate the second layer 26 which lies beneath first layer 24. Hole 22 can be reinforced to prevent fraying, perhaps, even decorated to make it a feature of the cap (i.e., take the shape of a football or team logo, for example). Closed-topped hat 20 has a bottom edge 27. The top of the closed-topped hat shown in FIG. 1 is seen in FIG. 2. Four corners 28A, 28B, 28C, and 28D have been stitched together to form the two orthogonal seams 29A and 29B of the top of the hat.

Figure 3A:
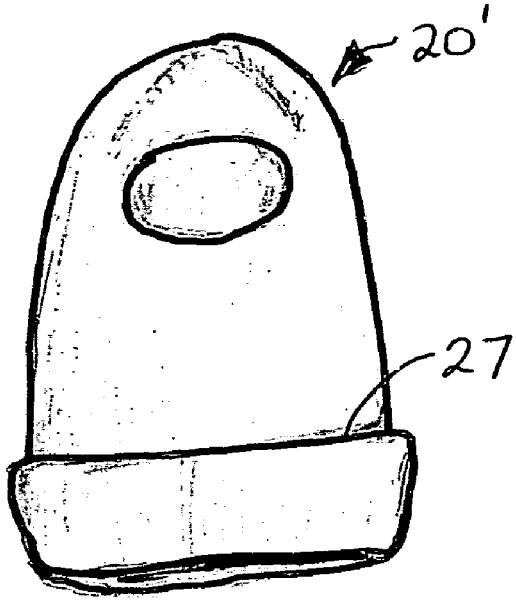
FIG. 3A is a schematic view of a first embodiment of the convertible garment of the present invention shown worn as a closed-topped hat.
Figure 3B:
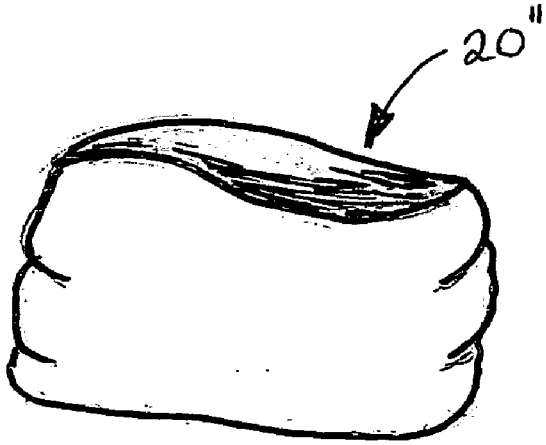
FIG. 3B is a front view of the first embodiment of the convertible garment of the present invention shown configured as a neck gaiter/muffler.

The two basic configurations of the convertible garment 20' are shown in FIGS. 3A and 3B. In FIG. 3A, the fabric is on a first side of hole 22 and the garment is configured as a closed-topped hat with the bottom edge 27 turned up to form a brim. FIG. 3B shows the second basic configuration of the convertible garment 20" with the fabric pulled through hole 22. While this configuration can be worn as a plurality of different garments, it is essentially a cylindrical tube of double thickness of material. This will be more easily understood with the following explanation of the method of making the garment.

Figure 4A:
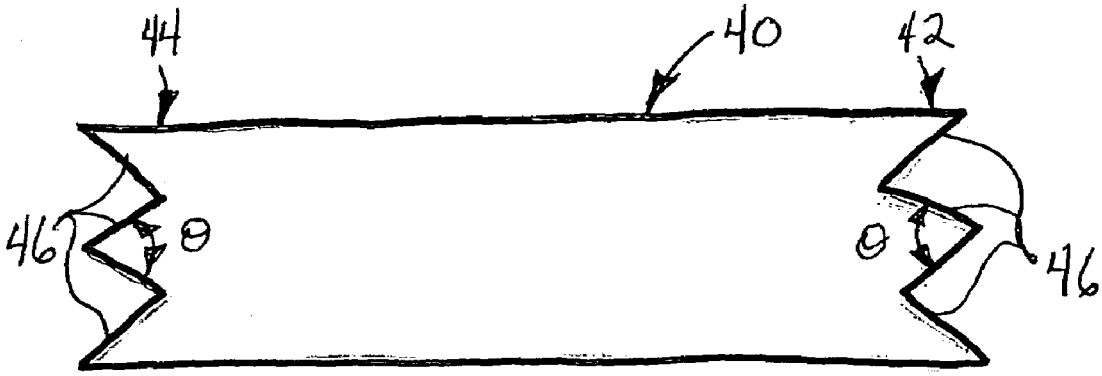
FIG. 4A is a front view of the tubular fabric prior to sewing shown in an extended position.
Figure 4B:
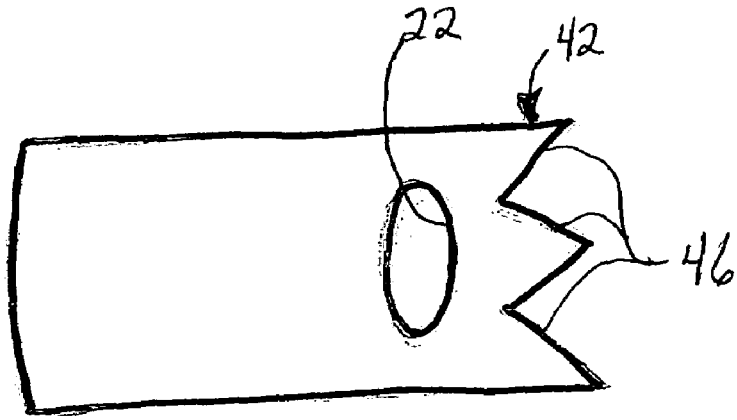
FIG. 4B is a front view of the tubular fabric shown in the position just prior to stitching.

Convertible garment 20 is formed from a tube of fabric 40 as shown in FIG. 4A. The two ends 42, and 44 are each formed with a plurality of V-shaped cuts 46 thereon (four as shown in FIG. 4A), each encompassing an angle θ of 90° (the two central cuts 46 in FIG. 4A shown full dimension while the two on the sides are folded in half). In FIG. 4B, second end 44 is pushed inside the tubular fabric and V-shaped cuts 46 of end 42 aligned with V-shaped cuts 46 of end 44. Hole 22 is formed in alignment with central cut 46 for optimum placement and operation of the convertible garment 20. V-shaped cuts 46 are then stitched along their peripheral edges to form a continuous loop of fabric, such that, when the top of the garment is flattened, it will appear as shown in FIG. 2.

Figure 5:
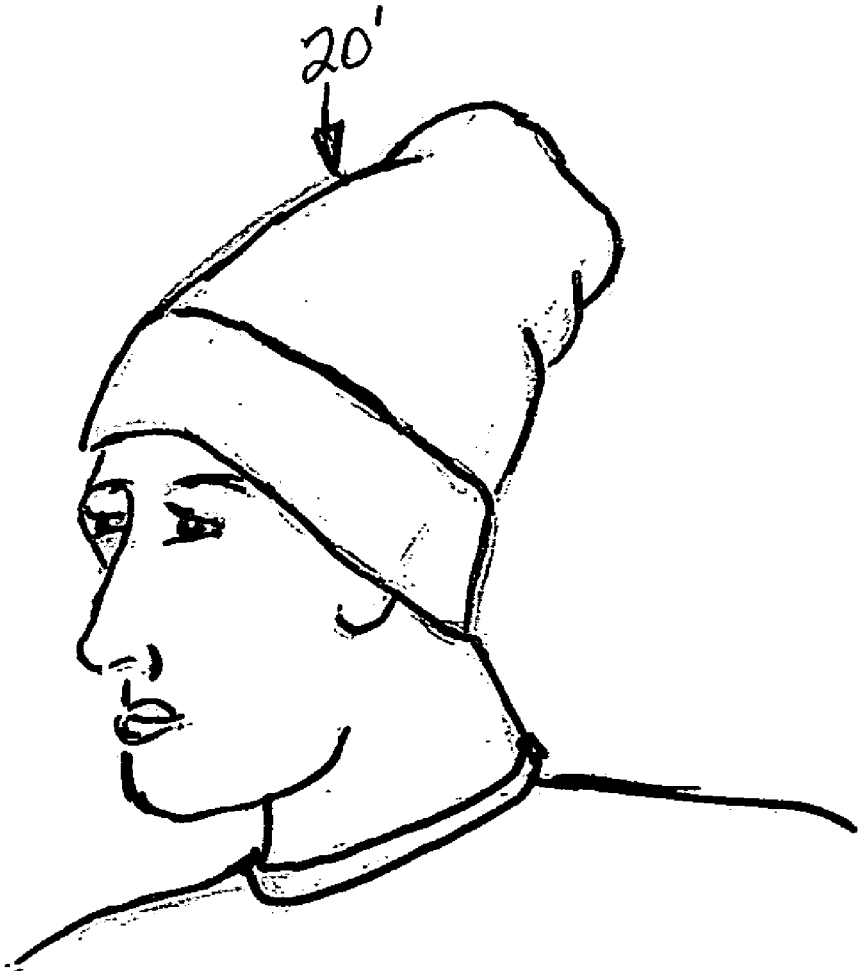
FIG. 5 is a schematic depiction of the first embodiment of the convertible garment of the present invention shown worn as a closed-topped hat.
Figure 6A:
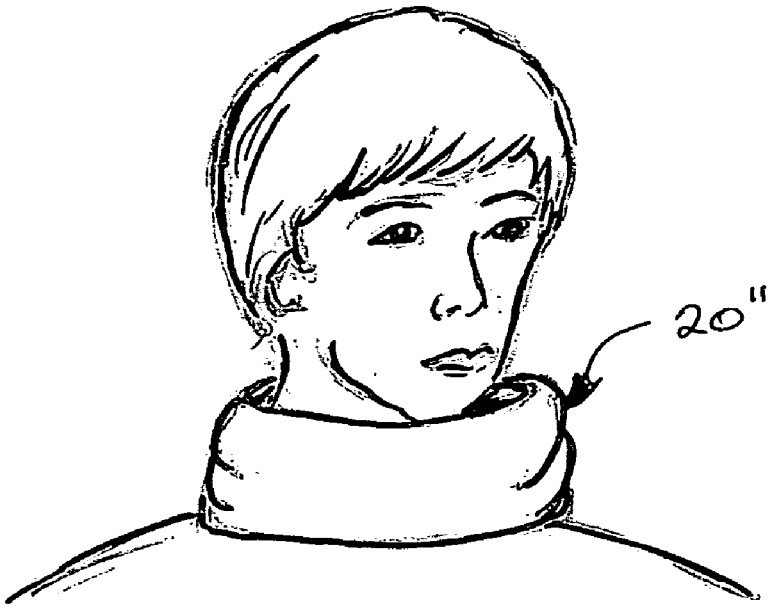
FIG. 6A is a schematic depiction of the first embodiment of the convertible garment of the present invention shown worn as a neck gaiter/muffler.
Figure 6B:
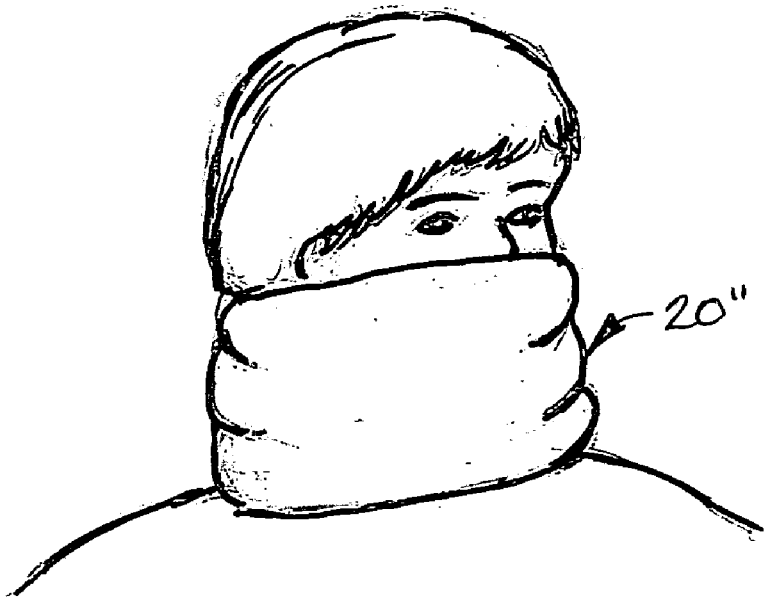
FIG. 6B is a schematic depiction of the first embodiment of the convertible garment of the present invention shown worn as a face gaiter/muffler.
Figure 6C:
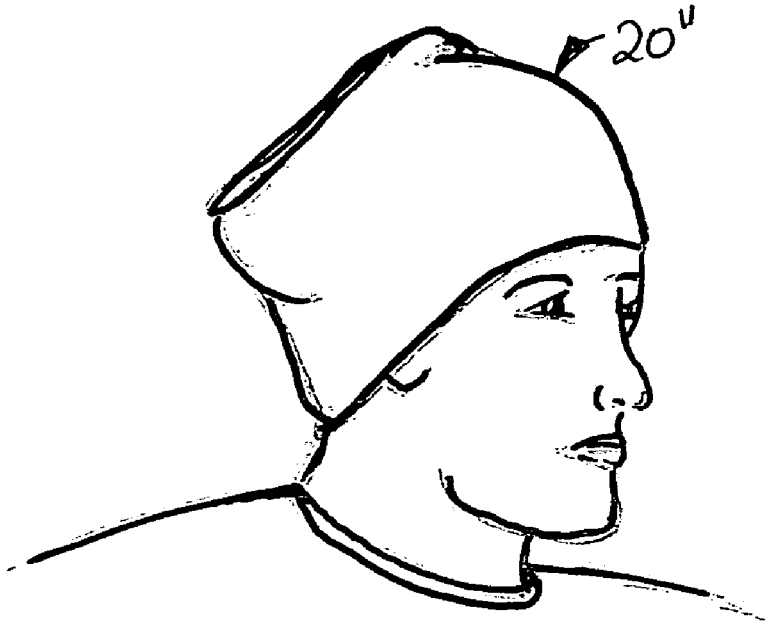
FIG. 6C is a schematic depiction of the first embodiment of the convertible garment of the present invention shown worn as an open-topped hat.
Figure 6D:
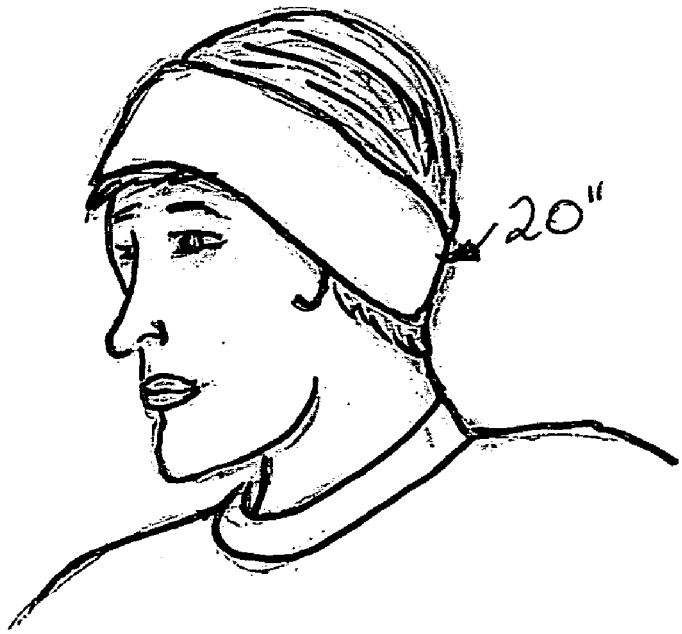
FIG. 6D is a schematic depiction of the first embodiment of the convertible garment of the present invention shown worn as a head band.

The closed-topped hat 20' is schematically depicted as it might be worn in FIG. 5. If the hat is worn with layer 24 out, then hole 22 will show and, has been mentioned earlier, hole 22 can be decorated so that its appearance is enhanced. If closed-topped hat 20' is turned such that layer 26 is on the outside, then hole 22 will be hidden within the interior of the garment. FIG. 6A depicts the convertible garment 20" pushed through hole 22 with the hole being hidden on the inner layer of the garment 20". In FIG. 6A the convertible garment 20" is doubled over and worn as a neck gaiter or muffler. In FIG. 6B, the garment 20" is shown worn as a face gaiter/muffler. FIG. 6C schematically depicts convertible garment 20" shown worn as an open-topped hat (which a skier may prefer to permit some desired heat loss. Finally, FIG. 6D shows the doubled-over garment 20" being worn as a head band.

As can be readily appreciated, the versatility of the convertible garment 20 permits this single garment to do the duty of as many as five different garments, one with the fabric on the first side of hole 22 as closed-topped hat 20', and four with the fabric pulled through the hole 22 configured as a cylindrical tube 22". It is envisioned that the convertible garment may be made out of any number of materials. By way of example, and not limitation, these would include POLARTEC® stretchable fleece; 100% polyester fleece; micro-fiber fleece; 100% polyester; polyester/wool blends; 100% wool; 100% acrylic; acrylic blends; SCENTLOC® odor control material; and LYCRA® fabric.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. A method of making a convertible garment comprising the steps of a) cutting a first plurality of V's on a first distal end of a tubular length of cloth, said tubular length of cloth having two layers, said first plurality of V's being formed on both layers;

b) cutting a second plurality of V's on a second opposing distal end of said tubular length of cloth, said second plurality of V's being formed on both layers;

c) creating a hole in one layer of said tubular length of cloth centered above one of said V's;

d) inverting said tubular length of cloth by pulling all of said tubular length of cloth through said hole;

e) aligning said first plurality of V's on said first distal end with said second plurality of V's on said second distal end;

f) stitching an outer periphery of aligned first and second distal ends such that each side of each V on said first distal end is sewn to a side of each V on said second distal end creating a continuous band of the tubular length of fabric.

2. A convertible garment manufactured by the method of claim 1, said convertible garment comprising a) a tubular length of fabric with a plurality of V's cut on a first end and a like plurality of V's cut on an opposing second end, each V having a pair of opposing sides;

b) said tubular length of fabric having i) one of each of said plurality of sides of said plurality of V's on said first end being stitched to an opposing one of each of said plurality of sides on said second end to create a continuous loop of fabric of said tubular length of fabric;

ii) a hole positioned in one face of said tubular length of fabric, said hole being of substantial size;

whereby said created continuous loop of tubular fabric may be worn as a number of items of apparel with said created loop right side out and, when desired, said created continuous loop of fabric may be turned inside out to form a closed-ended stocking cap.

3. The convertible garment of claim 2 wherein said plurality of V's equals four.

4. The convertible garment of claim 2 wherein said hole is directly aligned beneath one of said V's in said one face of said tubular length of fabric.

* * * * *